US005102173A

United States Patent [19]

Schallern

[11] Patent Number: 5,102,173

[45] Date of Patent: Apr. 7, 1992

[54] REENFORCER FOR DOORS AND WINDOWS

[76] Inventor: John R. Schallern, 4422 Cherokee Dr., Madison, Wis. 53711

[21] Appl. No.: 386,932

[22] Filed: Jul. 28, 1989

[51] Int. Cl.[5] ..... E05C 17/30

[52] U.S. Cl. ..... 292/288; 292/DIG. 46; 403/108

[58] Field of Search ..... 292/288, 338, 339, DIG. 46, 292/262; 403/108

[56] References Cited

U.S. PATENT DOCUMENTS

| | | | |
|---|---|---|---|
| 3,117,689 | 1/1964 | Dedic, Sr. | 217/60 |
| 3,486,781 | 12/1969 | Crum | 292/262 |
| 3,615,114 | 10/1971 | Harris | 292/288 |
| 3,797,005 | 3/1974 | Schwarz | 340/274 |
| 3,816,967 | 6/1974 | Littrell | 49/449 |
| 4,295,676 | 10/1981 | Smith | 292/262 |
| 4,442,427 | 4/1984 | Morton | 292/339 X |
| 4,461,502 | 7/1984 | Burgess | 292/262 |
| 4,570,985 | 2/1986 | Waldo et al. | 292/262 |
| 4,792,168 | 12/1988 | Kardosh | 292/288 |
| 4,834,413 | 5/1989 | Patel et al. | 403/108 X |

FOREIGN PATENT DOCUMENTS

| | | | |
|---|---|---|---|
| 2102495A | 2/1983 | United Kingdom | 292/339 |

OTHER PUBLICATIONS

Timtronics Technology Knight Stick Wireless Alarm directions sheet, p. 57, Hammacher Schlemmer Late Fall 1989 Mail Order Catalog.

*Primary Examiner*—Richard E. Moore

*Attorney, Agent, or Firm*—Henderson & Sturm

[57] ABSTRACT

A reenforcer (11) has a body (12) and an extension (13) which are disposed between and engage the sliding panel and the frame of typical sliding glass door or window assemblies to hinder movement of the sliding panel by an intruder. Improved adjustment and reenforcement characteristics are attained by coupling the base and extension by a reenforcement assembly (14), forming a plurality of holes (19), (24), (32) through the base, extension, and reenforcement assembly providing for selective alignment of said holes, and providing latch-borne knobs (28), (36) for selectively engaging the aligned holes.

2 Claims, 1 Drawing Sheet

Fig. 1
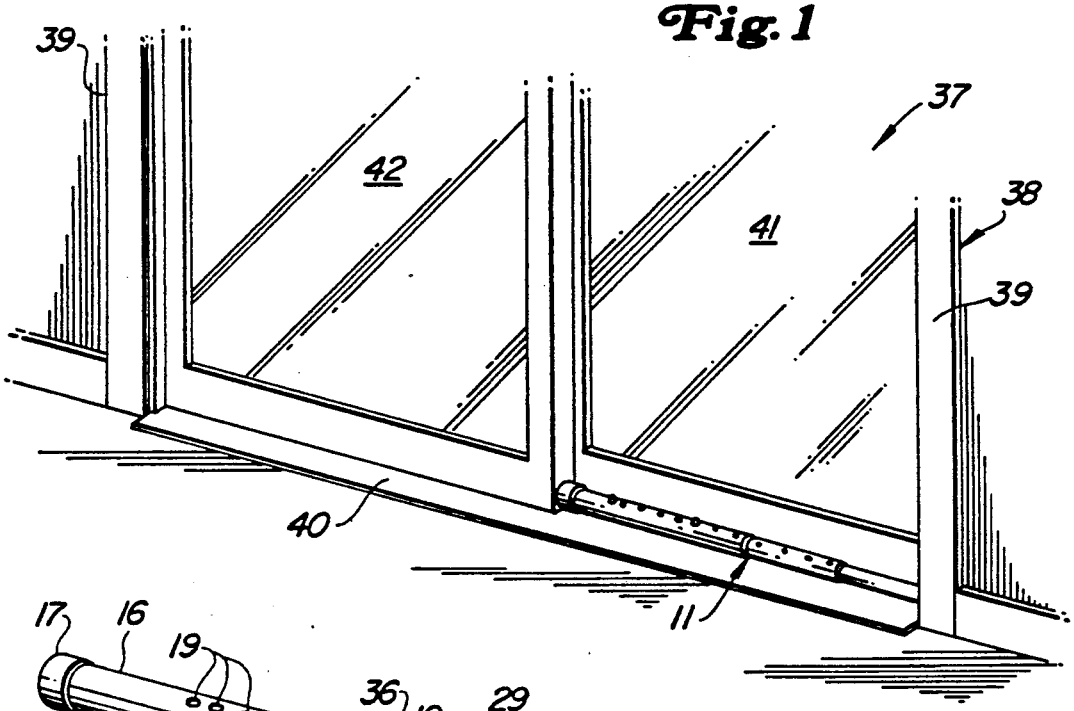
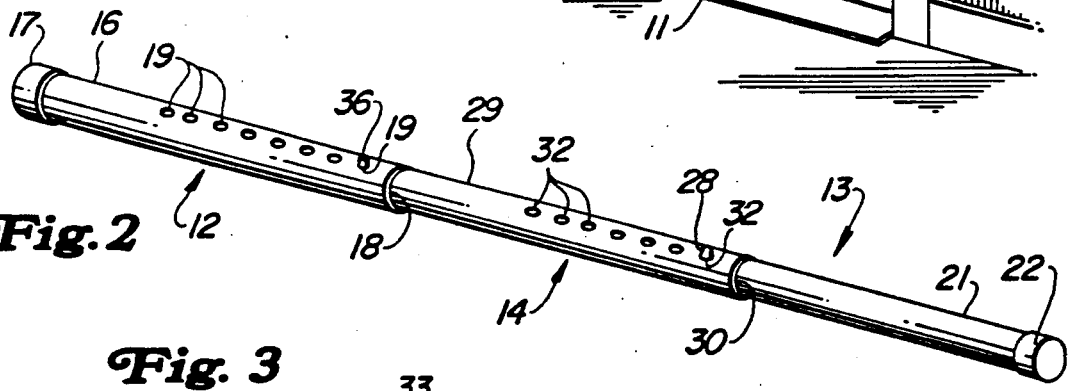
Fig. 2
Fig. 3
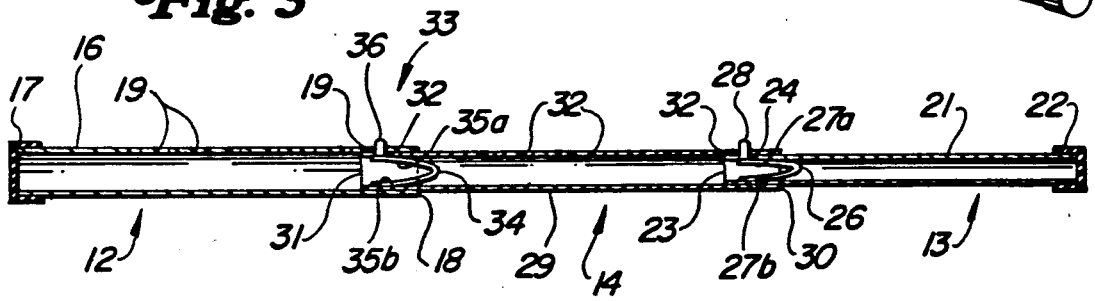
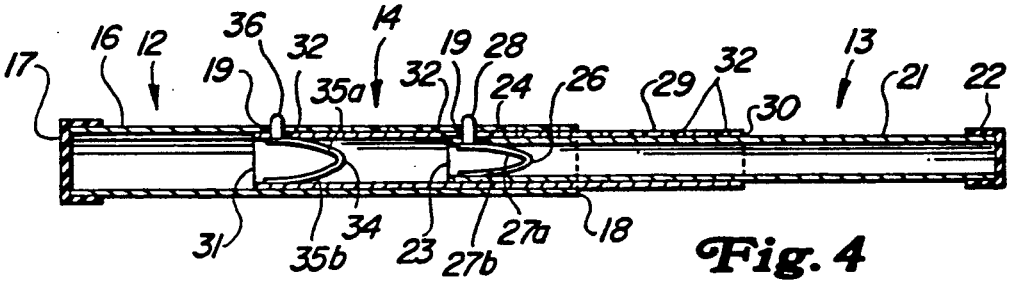
Fig. 4

REENFORCER FOR DOORS AND WINDOWS

TECHNICAL FIELD

This invention relates generally to sliding glass doors and windows. More particularly, it relates to devices employed to secure the sliding portions of those doors and windows against movement.

BACKGROUND ART

Sliding glass doors and windows generally have a first panel which is fixed to the frame and a second panel which is disposed parallel to the first and which slides in the frame, thereby opening and closing the door or window. Such doors and windows typically are equipped with latching mechanisms which engage the frame and hold the movable panel to the frame. Unfortunately, the typical latching mechanism provided with such doors and windows is relatively flimsy. Furthermore the design of such doors and windows is inherently more susceptible to being jammed or pried open, a condition aggravated by the level of sturdiness usually employed in such doors and windows most commonly constructed. Accordingly, there has been a substantial problem with burglars and other unauthorized intruders gaining access to premises as usage of sliding glass doors and windows has become more popular.

Numerous attempts have been made to develop devices for rendering sliding glass doors and windows more secure against unauthorized, forced entries. More particularly, bar devices have been designed which engage the sliding panel and the frame. However, development has tended toward relatively complex structures, many of which grasp, or are attached to, the sliding panel or frame in a cumbersome fashion.

DISCLOSURE OF INVENTION

Responding to the needs described above, this invention provides a reenforcer with a body and an extension which are disposed between and engage the sliding panel and the frame of typical sliding glass door or window assemblies. A reenforcement assembly slides within the body and slidably receives the extension thereby coupling the body and extension. Holes are formed through the body, reenforcement assembly, and extension which can be selectively aligned, and latches disposed within the reenforcement assembly and the extension selectively engage the aligned holes.

It is an objection of this invention to provide a device for the reenforcement of sliding panel doors and windows. More particularly, it is an object to provide a device which will hinder the efforts of potential intruders to move the sliding panels, thereby discouraging the intruder or at least providing additional time for occupants of a building to discover and react to the intruder.

Also an object is provision of such a device which is itself internally reenforced. A further object is provision of such a device which has superior overall adjustment characteristics.

Yet another object of this invention is to provide a reenforcer which is relatively inexpensive to fabricate. It is of sturdy construction and capable of achieving the afore-mentioned objects.

These objects and other features and advantages of this invention of a reenforcer for doors and windows will become readily apparent upon referring to the following description in conjunction with the appended drawing.

BRIEF DESCRIPTION OF THE DRAWINGS

The reenforcer invention is illustrated in the drawings wherein:

FIG. 1 is a fragmentary perspective view showing use of the reenforcer with a typical sliding door assembly;

FIG. 2 is an enlarged, perspective view of the reenforcer in fully extended configuration to show more clearly the components thereof;

FIG. 3 is an enlarged, longitudinal sectional view of the reenforcer in fully extended configuration to show more clearly the components thereof; and FIG. 4 is an enlarged, longitudinal sectional view of the reenforcer in a reenforced, double locked configuration.

BEST MODE FOR CARRYING OUT THE INVENTION

The reenforcer invention is shown generally at (11) in FIG. 2. The reenforcer (11) more particularly includes a base assembly (12), extension assembly (13) and reenforcement assembly (14).

The base assembly (12), see FIGS. 2 and 3, includes a generally cylindrical, tubular body (16). One end of the body (16) is covered as by a plastic or rubber end cap (17). The opposite end (18) of body (16) is open. A plurality of holes (19) are punched through the wall of body (16). The holes (19) extend substantially the length of the body (16) and are disposed in a straight line which is parallel to the longitudinal axis of the body (16). The holes (19) are uniformly spaced apart.

The extension assembly (13), again referring to FIGS. 2 and 3, includes a generally cylindrical, tubular body (21). A plastic or rubber end cap (22) closes one end of the tubular body (21). The opposite end (23) of the body (21) is open. A hole (24) is punched through the wall of body (21) adjacent end (23).

A latch (25) is inserted through end (23) into the body (21) but is not fixed to the body (21). The latch (25) more particularly includes a generally U-shaped spring clipped body (26) having free ends **(27*a*), (27*b*). A knob (28) is formed into free end (27*a*). The knob (28) is generally normal to free end (27*a*) and extends away from free end (27*b*). The latch (25) is positioned so that the knob (28) may engage, and project outwardly through the hole (24)**.

Again referring to FIGS. 2 and 3, the reenforcement assembly (14) includes a generally cylindrical, tubular body (29) having a first open end (30) and an opposite, second open end (31). A plurality of holes (32) are punched through the wall of body (29). The holes (32) extend substantially between the ends (30), (31) and are arranged in a line which is substantially parallel to the long axis of the body (29). The holes (32) are uniformly spaced apart a distance substantially the same as that separating the holes (19).

A latch (33) is inserted through end (31) into body (29). The latch (33) is comprised of a U-shaped spring clip member (34) having free ends **(35*a*), (35*b*). A knob (36) is punched into the free end (35*a*), is disposed generally normal to free end (35*a*), and extends away from free end (35*b*). The latch (33) is not fixed to the wall of the body (29), but it is disposed generally such that the knob (36) may engage, and project outwardly through, one of the holes (32)**.

The reenforcer (11) is assembled by inserting end (31) of body (29) through end (18) of body (16). Clip (34) bends, such that knob (36) withdraws through a hole (32) into body (29), thereby allowing body (29) to slide within body (16). Similarly, end (23) of body (21) is inserted through end (30) of body (29). Clip (26) bends, allowing knob (28) to withdraw through hole (24) into body (21), thereby allowing body (21) to slide within body (29). Body (29) can be latched to body (16) by aligning the appropriate hole (32) with a hole (19) such that knob (36) engages and projects outwardly through the aligned holes (19), (32). Body (21) can be latched to body (29) by aligning hole (24) with a hole (32), thereby allowing knob (28) to engage and project outwardly through aligned holes (24), (32). Further, body (21) can be latched to both bodies (16), (29) by alignment of hole (24) with an aligned pair of holes (19), (32), such as shown in FIG. 4.

The bodies (16), (21), (29) are fabricated by standard metal forming techniques from suitable metal alloys of aluminum or steel. The end caps (17), (22) likewise are made by methods well known in the plastics and rubber arts.

Referring to FIG. 1, the reenforcer (11) is shown in use with a typical sliding door assembly (37). A door frame (38) includes door jambs (39) and a door sill (40). One door panel (41) is fixed to the frame (38) and is disposed to the exterior of the room, and the second door panel (42) is slidably mounted in the frame (38) and disposed toward the interior of the room.

The reenforcer (11) has the configuration shown in FIG. 4. The end caps (17), (22) engage the edge of sliding panel (42) and a door jamb (39) respectively. The caps (17), (22) by friction provide some grip but while minimizing marring of the engaged surfaces. Should an intruder break the door lock, or otherwise attempt to jam the door open, the reenforcer (11) impedes movement of the sliding panel (42). Frequently such additional resistance will discourage a jittery potential intruder. The intruder at least will be frustrated and delayed, thereby increasing the likelihood the intruder will be seen or will make some noise while breaking in that will alert the occupants of the building. In general the reenforcer (11) will operate to provide some additional time for the occupants to discover and react to any intruder. Although a completely closed door is shown in FIG. 1, the reenforcer (11) can be employed in situations where the door or window has been left slightly open, such as to permit a breeze through the building, to hinder any attempt by an intruder to force the door or window fully open.

The reenforcer (11) configured as in FIG. 4 displays several advantages of the reenforcement assembly (14). The body (29) in general makes the reenforcer (11) a stronger structure than conventional devices which typically are of two pieces. Further, selected alignment of holes (19), (24), (32) and bodies (21), (29) effectively provides for a double latching of assembly (13), by reenforcement assembly (14), to the base (12). Selective alignment of the holes (19), (24), (32) and engagement by knobs (28), (36) provide the reenforcer (11) with superior overall adjustability.

The industrial applicability of this reenforcer for doors and windows is believed to be apparent from the foregoing description. Although a preferred embodiment has been disclosed herein, it is to be remembered that various alternate constructions can be made without departing from the scope of the invention.

I claim:

1. A reenforcer, for use with window and door assemblies having a sliding panel movable with respect to a frame, comprising:

an elongated tubular body forming a first interior space having a first open end communicating with said space, an opposite first closed end, and a plurality of first holes formed through said body and communicating with said space;

an elongated tubular extension forming a second interior space, having a second open end communicating with said second space and an opposite second closed end, at least one second hole formed through said extension and communicating with said second space, and first latch means disposed within said second space and projectable through said second hole;

an elongated tubular reenforcement forming a third interior space, having third open ends communicating with said third space, and a plurality of third holes formed through said reenforcement and communicating with said third space, and second latch means disposed within said third space and projectable through said third holes;

said reenforcement being received through said first open end into said first space, said extension being received through a third open end into said third space, said reenforcement being movable with respect to said body and extension to align selectively said first, second and third holes, to permit engagement of said selectively aligned holes by said latch means, and to couple said latch means, said reenforcement being positionable such that at least one of said latch means projects through an aligned first, second and third holes, whereby said body and extension are reenforced and double latched.

2. The reenforcer of claim 1 and further wherein said body, extension and reenforcement are so positioned that at least one hole each of said first, second and third holes are aligned and said first latch means projects through said aligned holes.

* * * * *